US010086226B2

(12) United States Patent
Nelson et al.

(10) Patent No.: US 10,086,226 B2
(45) Date of Patent: Oct. 2, 2018

(54) ENERGY ABSORBING WEIGHT BAR SUPPORT ASSEMBLIES FOR EXERCISE EQUIPMENT

(71) Applicant: Brunswick Corporation, Lake Forest, IL (US)

(72) Inventors: Westin W. Nelson, Dayton, MN (US); Dennis Whaley, Otsego, MN (US); John M. Cassidy, Otsego, MN (US); Mathew R. Meyer, Hanover, MN (US)

(73) Assignee: Brunswick Corporation, Mettawa, IL (US)

( * ) Notice: Subject to any disclaimer, the term of this patent is extended or adjusted under 35 U.S.C. 154(b) by 326 days.

(21) Appl. No.: 15/055,797

(22) Filed: Feb. 29, 2016

(65) Prior Publication Data

US 2017/0246496 A1 Aug. 31, 2017

(51) Int. Cl.

| | |
|---|---|
| ***A63B 21/078*** | (2006.01) |
| ***A63B 21/00*** | (2006.01) |
| ***A63B 21/072*** | (2006.01) |

(52) U.S. Cl.

CPC ..... *A63B 21/078* (2013.01); *A63B 21/0724* (2013.01); *A63B 21/0783* (2015.10); *A63B 21/4035* (2015.10)

(58) Field of Classification Search

CPC ..... A63B 21/0724; A63B 21/078; A63B 21/0783; A63B 21/4035

See application file for complete search history.

(56) References Cited

U.S. PATENT DOCUMENTS

| | | | | |
|---|---|---|---|---|
| 4,368,884 | A | 1/1983 | Colvin | |
| 4,799,673 | A | 1/1989 | Selle | |
| 5,011,141 | A | 4/1991 | Towley, III et al. | |
| 5,281,193 | A | 1/1994 | Colbo, Jr. | |
| 5,509,876 | A | 4/1996 | Reyes | |
| 5,971,898 | A | 10/1999 | Schoolfield | |
| D444,827 | S * | 7/2001 | Mobley | D21/694 |
| 6,447,433 | B1 | 9/2002 | Reyes | |
| 6,623,409 | B1 | 9/2003 | Abelbeck | |
| 7,070,546 | B1 | 7/2006 | Grasso | |
| 7,338,416 | B2 * | 3/2008 | Smith | A63B 21/078 248/125.3 |
| 7,699,756 | B2 * | 4/2010 | Piane, Jr. | A63B 1/00 482/38 |

(Continued)

OTHER PUBLICATIONS

EPO Extended Search Report and Written Opinion, EP Patent Application No. 17156663.1, dated Jul. 3, 2017.

*Primary Examiner* — Joshua Lee

(74) *Attorney, Agent, or Firm* — Andrus Intellectual Property Law, LLP

(57) ABSTRACT

A weight bar support assembly for safely supporting a weight bar on exercise equipment in the event the user cannot return the weight bar to its original position includes an attachment bracket and a weight support member forming a catch arm which is selectively engaged with and moved away from an upright of the exercise equipment. An energy absorbing arrangement is incorporated within either the attachment bracket or the weight support member, and is configured to cushion forces transmitted to the upright upon contact of the weight bar with the weight support member to prevent deformation and/or damage of the exercise equipment.

8 Claims, 8 Drawing Sheets

(56) References Cited

U.S. PATENT DOCUMENTS

| | | | | |
|---|---|---|---|---|
| 7,753,830 | B1 * | 7/2010 | Marsh | A63B 21/078 482/104 |
| 9,333,387 | B2 * | 5/2016 | Hopperstad | A63B 21/078 |
| 9,345,923 | B2 * | 5/2016 | Haggard | A63B 21/078 |
| 9,409,048 | B1 * | 8/2016 | Hopperstad | A63B 21/078 |
| 9,498,670 | B1 * | 11/2016 | Hopperstad | A63B 21/078 |
| 9,630,046 | B2 * | 4/2017 | Childs | A63B 21/078 |
| 9,649,525 | B2 * | 5/2017 | Hopperstad | A63B 21/078 |
| 9,907,991 | B2 * | 3/2018 | Leipheimer | A63B 21/0783 |
| 2002/0142893 | A1 | 10/2002 | Koenig | |
| 2006/0035765 | A1 * | 2/2006 | Smith | A63B 21/078 482/94 |
| 2007/0155594 | A1 * | 7/2007 | Rogers | A63B 71/0036 482/94 |
| 2014/0200117 | A1 | 7/2014 | Grider | |
| 2015/0083681 | A1 * | 3/2015 | Childs | A63B 21/078 211/85.7 |
| 2015/0224358 | A1 * | 8/2015 | Chen | A63B 21/16 248/327 |
| 2015/0290488 | A1 * | 10/2015 | Hopperstad | A63B 21/078 482/38 |
| 2016/0206913 | A1 * | 7/2016 | Haggard | A63B 21/078 |
| 2017/0007877 | A1 * | 1/2017 | Leipheimer | A63B 21/0783 |

* cited by examiner

ENERGY ABSORBING WEIGHT BAR SUPPORT ASSEMBLIES FOR EXERCISE EQUIPMENT

FIELD

The present disclosure pertains to weight supporting assemblies. The illustrated embodiments relate preferably to exercise equipment and adjustable assemblies for holding, supporting and catching a weight bar, such as used in conjunction with a weight rack.

BACKGROUND

During fitness exercises such as weightlifting, a user may lift a weight during exercises such as bench or shoulder presses, squats and other exercises involving free weights. Commonly, exercise equipment, such as weight racks, are used by themselves or in combination with other equipment such as weight benches to adjustably support the weight bar for such exercises before and after exercise movements. In the event a user is unable to return the weight bar to its original starting position, it is known to provide adjustable stops or arms on the exercise equipment to prevent damage to the exercise equipment and supporting surface therefor.

SUMMARY

This summary is provided to introduce a selection of concepts that are further described herein below in the detailed description. This summary is not intended to identify key or essential features of the claimed subject matter, nor is it intended to be used as an aid in limiting the scope of the claimed subject matter.

In some examples, a weight bar support assembly is provided for supporting a weight bar on exercise equipment having an upright formed with a receiving arrangement. The weight bar support assembly includes a catch arm having an attachment bracket and a weight support member. The attachment bracket is configured to be engaged with the upright in non-surrounding relationship therewith, and provided with engagement structure extending therefrom for selective engagement with one desired setting of the receiving arrangement such that the attachment bracket is maintained in the one desired setting on the upright when the engagement structure is engaged with the receiving arrangement. The weight support member extends forwardly from the attachment bracket and is configured for supporting the weight bar on the exercise equipment when the engagement structure is engaged with the receiving arrangement. The attachment bracket and the weight support member are configured to be selectively disengaged and moved away from the upright at the one desired setting upon disengagement of the engagement structure from the receiving arrangement when it is desired to change a position of the attachment bracket and the weight support member from the desired setting to a different desired setting. An energy absorbing arrangement is incorporated within at least one of the attachment bracket and the weight support member, and is configured for cushioning a force transmitted to the upright upon contact of the weight bar with the weight support member.

In other examples, a weight bar support assembly is provided for supporting a weight bar on exercise equipment having an upright formed with a receiving arrangement. The weight bar support assembly includes a catch arm having an attachment bracket and a weight support member. The attachment bracket is configured to be engaged with the upright in non-surrounding relationship therewith. The attachment bracket includes a front wall, a first side wall extending rearwardly from one side of the front wall, a rear wall joined to the first side wall and a second side wall extending rearwardly from another side of the front wall and disconnected from the rear wall. The first side wall is provided with an engagement structure which is slidably and rotatably received within a set of aligned apertures of the receiving arrangement formed in the upright for maintaining the attachment bracket in one desired setting on the upright. The weight support member extends forwardly from the front wall and is configured for supporting the weight bar on the exercise equipment when the engagement structure is received in the aligned apertures. An energy absorbing arrangement is incorporated within the attachment bracket and is configured for cushioning a force transmitted to the upright upon contact of the weight bar with the weight support member. The energy absorbing arrangement includes a first cushioning pad provided on an inside surface of the front wall, and a second cushioning pad provided on an inside surface of the rear wall.

In additional examples, a weight bar support assembly is provided for supporting a weight bar on exercise equipment having an upright formed with a receiving arrangement. The weight bar support assembly includes a catch arm having an attachment bracket and a weight support member. An energy absorbing arrangement is configured for cushioning a force transmitted to the upright upon contact of the weight bar with the weight support member. The energy absorbing arrangement includes a cushioning element arrangement positioned within the weight support member.

BRIEF DESCRIPTION OF THE DRAWINGS

Examples of weight bar support assemblies are described with reference to the following Figures. The same numbers are used throughout the Figures to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different assemblies described herein may be used alone or in combination with other devices and/or assemblies. Various equivalents, alternatives and modifications are possible within the scope of the appended claims.

Figure 1:
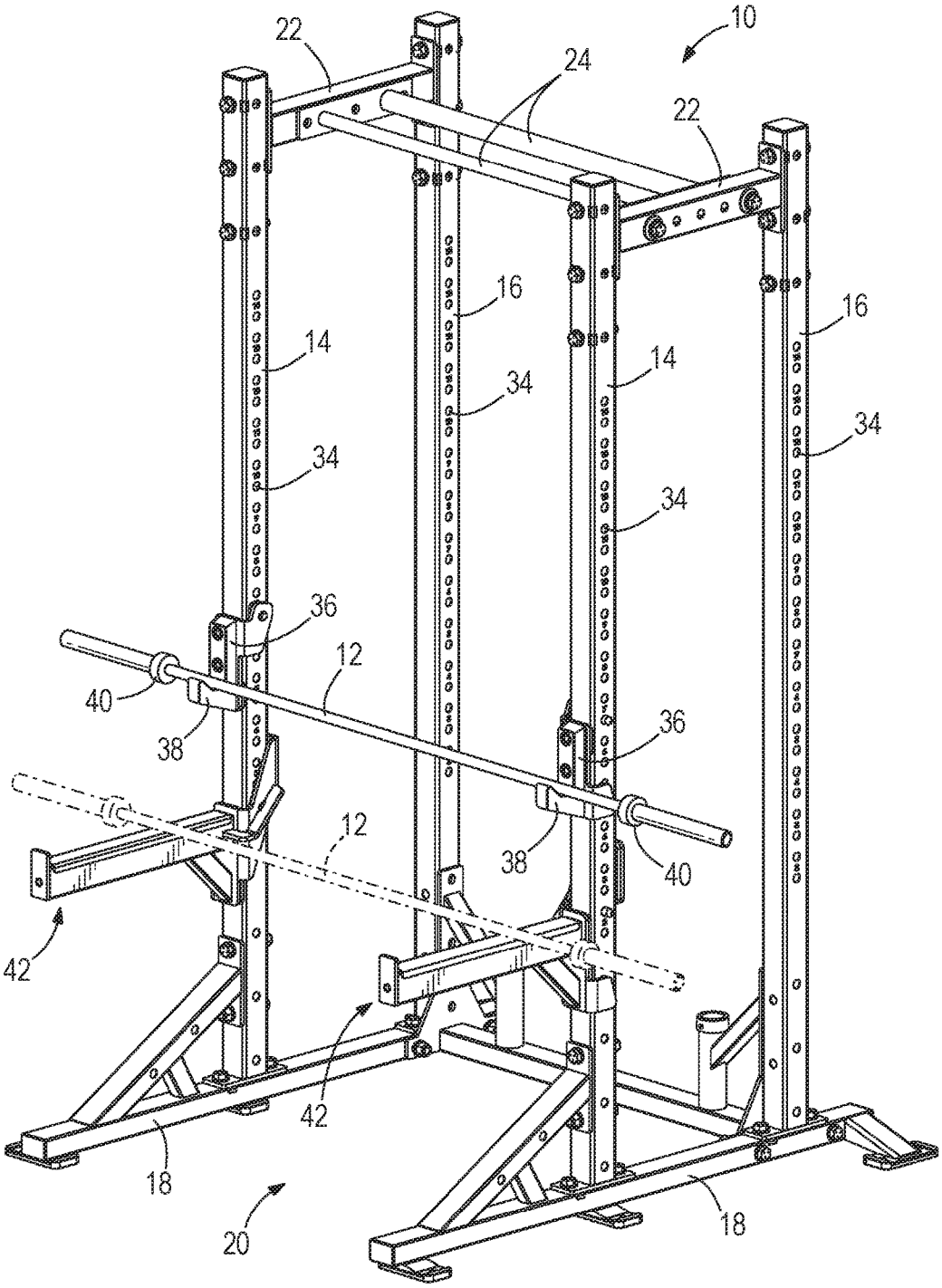
FIG. 1 is a front perspective view of exercise equipment in the form of a weight rack provided with a weight bar support assembly in accordance with one embodiment of the present disclosure.
Figure 3:
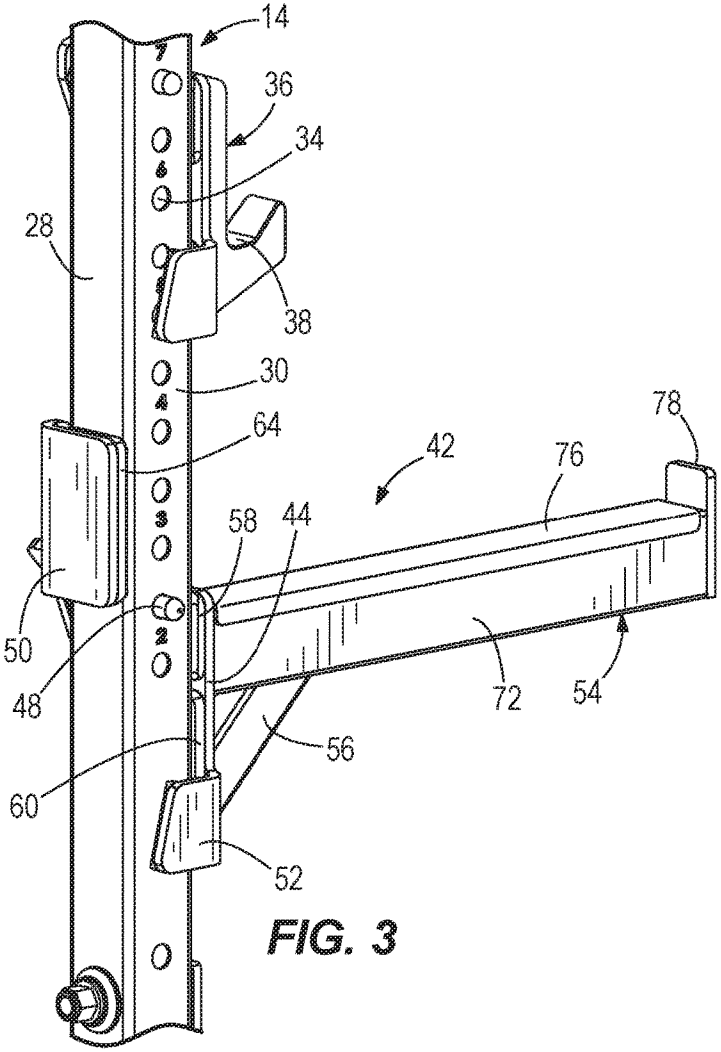
FIG. 3 is a rear view of the upright and weight bar support assembly shown in FIG. 2.
Figure 2:
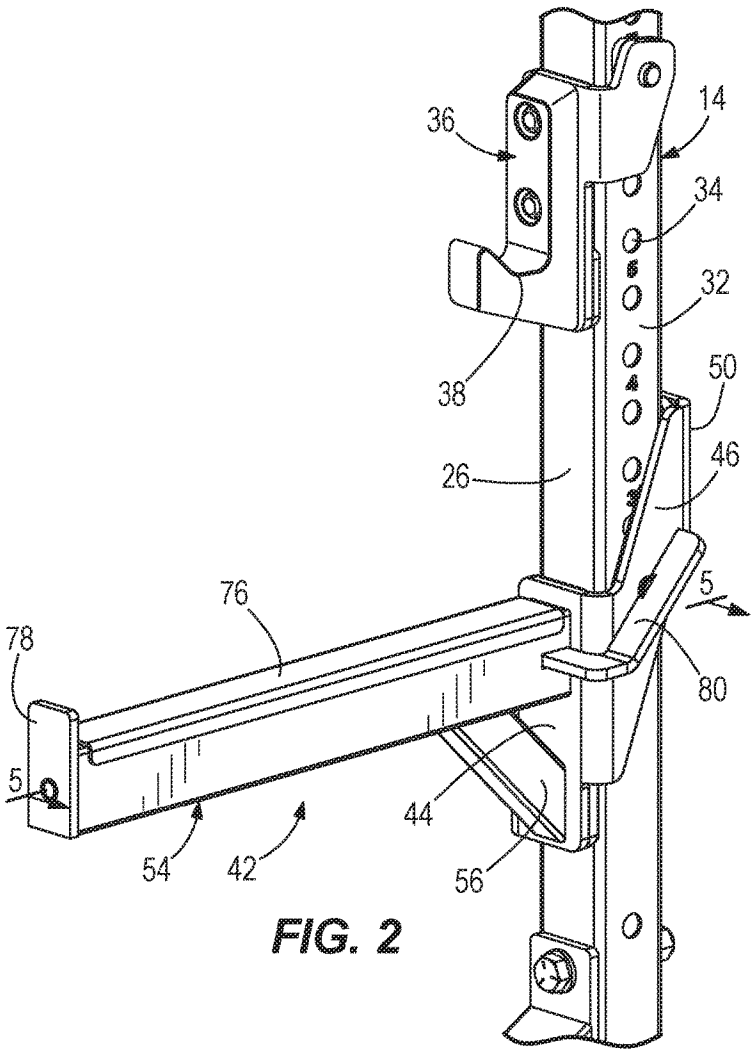
FIG. 2 is a partial front perspective view of a left front upright of the weight rack of FIG. 1 equipped with the weight bar support assembly.

FIG. 1 depicts exercise equipment including a weight rack 10 and a weight bar 12. The weight rack 10 and the weight bar 12 are exemplary and provide only one example of use. The present disclosure is applicable to other apparatus and/or structural assemblies in addition to the weight rack 10 shown in FIG. 1. The weight rack 10 includes a set of vertically extending support columns defined by a pair of front uprights 14 and a pair of rear uprights 16 which extend above and are supported by base frame members 18 positioned on a support surface 20. Upper ends of the front and rear uprights 14, 16 are joined to connecting members 22 and cross support members 24. Each of the front and rear uprights 14, 16 shown in FIG. 1 is typically constructed as a rectangular tube having flat mounting surfaces, although other shaped tubular constructions with suitable mounting faces are contemplated. As seen best in FIGS. 2 and 3, the upright mounting faces include an upright front face 26, a rear face 28 and opposing left and right side faces 30, 32, respectively, the latter being formed along their length with a receiving arrangement, which in the illustrated example is defined by a plurality of aligned circular apertures 34 extending through the left and right side faces 30, 32.

The plurality of apertures 34 on the front and rear uprights 14, 16 permit a pair of weight bar holders 36 to be slidably attached to and retained, such as by pins, on front and rear uprights 14, 16 at a variety of heights. The weight bar 12, usually with attached weight plates secured thereon (not shown), sits in a resting position supported by the weight bar holders 36. The weight bar holders 36 are suitably formed, such as with a cradle portion 38, for receiving and supporting the weight bar 12 therein. Preferably, with the weight bar 12 removed, the weight bar holders 36 on the front uprights 14 will be adjusted to the same height so that the weight bar 12 will be generally level when supported by the weight bar holders 36. The weight bar 12 typically includes collars 40 attached thereto for preventing the weight plates from slipping inwardly on the weight bar 12 which would interfere with placement of the weight bar 12 relative to the weight bar holders 36. The location of the weight bar holders 36 should be at a position from which a user removes the weight bar 12 to begin exercising, and normally returns the weight bar 12 at the conclusion of the exercise. It should be understood that the weight rack 10 shown in FIG. 1 may vary in configuration and may take other forms such as a Smith rack (not shown). In addition, it should be appreciated that the weight rack 10 and the weight bar 12 can be used by themselves when performing exercises such as bicep curls, standing shoulder presses or squats, or can be used with a fixed or adjustable weight bench (not shown) when carrying out other exercises such as bench presses or seated shoulder presses.

In accordance with the present disclosure, FIGS. 1-5 illustrate one embodiment of a weight bar support assembly in the form of a catch arm 42 which is provided on each of the front uprights 14. The catch arms 42 are configured to support and retain the weight bar 12 (such as shown in phantom lines of FIG. 1) in the event a user is unable to return the weight bar 12 to the weight bar holders 36 upon completion of the exercise. However, in some cases, as will be explained below, the catch arms 42 may function to support and retain the weight bar 12 in a standing or rest position.

Each catch arm 42 includes a front wall 44, a first side wall 46 provided with an engagement member 48, a rear wall 50, a second side wall 52, an elongated support member 54 for supporting and retaining the weight bar 12 and a brace 56 extending between the front wall 44 and the underside of the elongated support member 54.

Figure 4:
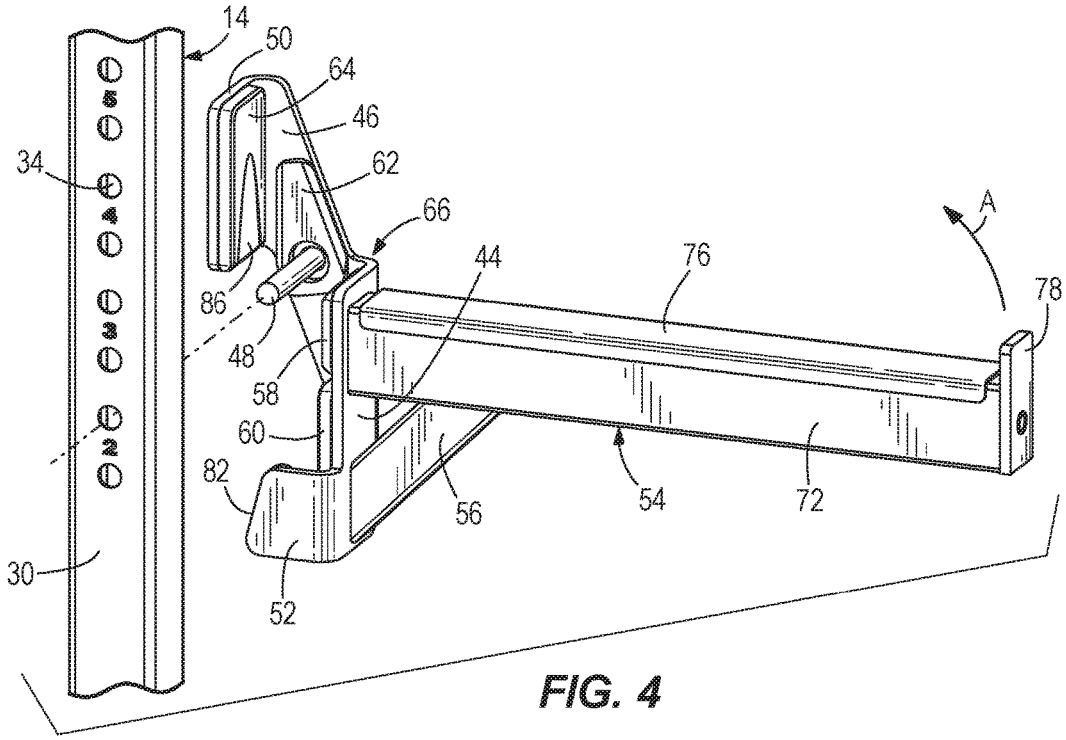
FIG. 4 is an exploded view of the weight bar support assembly on the upright shown in FIG. 2.
Figure 5:
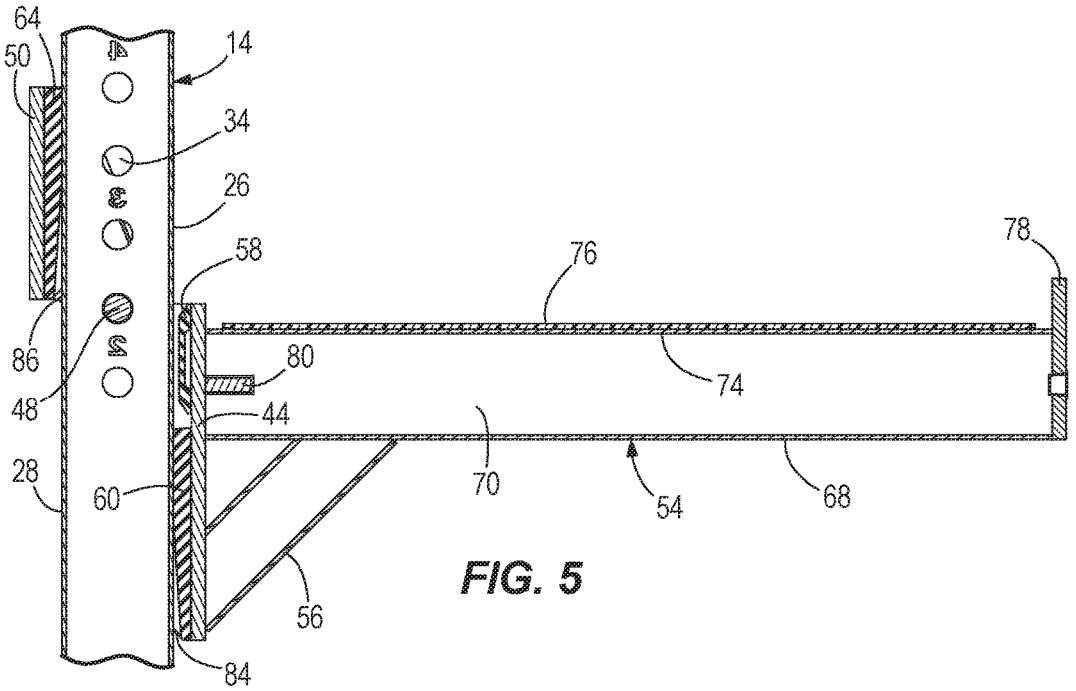
FIG. 5 is a sectional view of the weight bar support assembly installed on the upright as taken on line 5-5 of FIG. 2.

Referring to FIGS. 2-5, the first side wall 46 extends at an angle rearwardly and upwardly from one side of the front wall 44, and is joined at an upper end thereof to the rear wall 50, which extends above the front wall 44 with respect to the respective upright 14, 16. The second side wall 52 extends rearwardly from a lower portion on another side of the front wall 44, and is positioned below the rear wall 50. An inner upper surface of the front wall 44 includes a bearing pad 58, and an inner lower surface of the front wall 44 is provided with a first energy absorbing material in the form of a cushioning pad 60. An inner surface of the first side wall 46 includes a wear pad 62 through which the engagement member 48 projects. In the example shown, the engagement member 48 defines engagement structure which takes the form of a cylindrical pin member that extends perpendicularly and inwardly from the first side wall 46, and is located between the front wall 44 and the rear wall 50 with respect to the respective upright 14, 16. The engagement member 48 is configured so that it extends through one of the apertures 34, and projects beyond the left side face 30 of the upright 14. The length and shape of the engagement member 48 can be varied with the configuration of the apertures 34 and the upright 14. An inner surface of the rear wall 50 is provided with a second energy absorbing material in the form of a cushioning pad 64. As seen in FIGS. 4 and 5, each of the cushioning pads 60, 64 is formed with respective recesses 84, 86 which flare downwardly and open from bottom edges of the cushioning pads 60, 64 for a purpose to be explained herein below.

Together, the front wall 44, the first side wall 46, the engagement member 48, the rear wall 50, the second side wall 52, the bearing pad 58, the cushioning pad 60, the wear pad 62, and the cushioning pad 64 collectively define an attachment bracket 66 which is configured for selective frictional and cushioning engagement with the mounting faces of the upright 14 in non-surrounding, partially enclosed relationship therewith.

A proximal end of the elongated support member 54 is welded or otherwise affixed to the front wall 44 so that the support member 54 extends forwardly therefrom. The support member 54 includes a bottom surface 68, a pair of side surfaces 70, 72 and a top surface 74 which is preferably covered by a wear lining 76. A distal end of the support member 54 is provided with an end plate 78 which extends above the wear lining 76. The end plate 78 serves as a catch to prevent the weight bar 12 from rolling off the distal end of the support member 54.

In the example shown in FIGS. 1-5, the support member 54 is formed with a rectangular tubular cross section. Other shapes and structures may be employed to form the elongated support member 54 which is bolstered by the brace 56. A handle 80 (FIG. 2) is fixed to outer surfaces of the first side wall 46 and the front wall 44, and extends into the side surface 70 of the elongated support member 54.

The front wall 44, the first side wall 46, the engagement member 48, the rear wall 50, the second side wall 52, the elongated support member 54, the brace 56, and the handle 80 are typically formed of rigid durable metal material while the bearing pad 58 and the wear pad 62 are constructed of non-metal material, such as thermoplastic.

In accordance with the present disclosure, the cushioning pads 60, 64 provided on facing surfaces of the front wall 44 and the rear wall 50 are constructed from an energy absorbing material, such as elastomer, which provides dampening and shock absorbing characteristics responsive to the transmittal of forces to the upright 14 on which the catch arm 42 is mounted as will be better understood below.

The catch arm 42 shown in FIGS. 1-5 is designed to be installed and adjusted from the right side face 32 of the front upright 14, and is moveable between a released or removed position shown on FIG. 4 and a working engaged position as shown in FIGS. 1-3 and 5 by using a combination of tilting and lateral motion of the catch arm 42 relative to the upright 14 as is more fully detailed below.

In an exemplary use, the catch arms 42 need to be set at a height such that if a user performing exercises, such as on a bench, is too exhausted to raise the weight bar 12 back to a starting position as defined by the weight bar holders 36, the user may lower the weight bar 12 such that the user may safely leave the bench or, if the user should inadvertently drop or otherwise lose a grip on the weight bar 12, the catch arms 42 will catch the weight bar 12 and prevent it from falling on the user. Therefore, it is important to adjust the position of the catch arms 42 to an appropriate height for the exercise being performed.

In some cases, a user of the weight rack 10 shown in FIG. 1 may choose to use the catch arms 42 to support the weight bar 12 in a starting position. For example, if performing bicep curls with the weight bar 12, a user may choose to use the catch arms 42 because of their convenient position in a manner similar to the weight bar holders 36. In the event the weight bar 12 was dropped or could not be controlled by the user, the weight bar 12 would be intercepted and caught by catch arms 42 thereby avoiding damage to the support surface 20.

FIGS. 1-3 and 5 illustrate the engaged working position of the catch arm 42 on an upright 14 of the weight rack 10. To reach the engaged position, the catch arm 42 shown in FIG. 4 is tilted slightly rearwardly and upwardly (as represented by arrow A) and then moved laterally towards the right side face 32 of the upright 14 so that the cushioning pad 64 on rear wall 50 slidably engages the upright rear face 28, the bearing pad 58 and cushioning pad 60 on front wall 44 slidably engage the upright front face 26, the second side wall 52 aided by the truncated edge 82 thereon clears the upright front face 26 and engagement member 48 passes through the apertures 34 and projects beyond the left side face 30 at one desired setting.

The catch arm 42 is then tilted slightly forwardly and downwardly so that the second side wall 52 engages the left side face 30 to attain the engaged working position. In this position as seen in FIG. 5, the bearing pad 58 is slightly spaced from the upright front face 26 and the cushioning pad 60 is frictionally and dampingly engaged against the upright front face 26 except for an area defined by the recess 84. The cushioning pad 64 is frictionally and dampingly engaged against the upright rear face 28 except for an area defined by the recess 86. The wear pad 62 on the inside surface of first side wall 46 is frictionally engaged against the right side face 32. A wear pad (not shown) can be provided on an inner surface of the second side wall 52 so that it is frictionally engaged against the left side face 30.

It should be understood that in the engaged position, the catch arm 42 provides a spatial orientation that allows for a rotational degree of freedom about a pivot axis of the engagement member 48 which is rotatably received within forming walls of the apertures 34. When a downward force is applied upon the support member 54 due to contact with the loaded weight bar 12, it creates a rotational moment that functions to force the front wall 44 and cushioning pads 60 against the upright front face 26 such that the cushioning pad 60 is compressed. Simultaneously the rear wall 50 and the cushioning pad 64 are forcefully pressed against the upright rear face 28. The recesses 84, 86 formed in the cushioning pads 60, 64 are particularly configured to distribute the prevailing forces towards outer edges of the cushioning pads 60, 64 which overlap with outer edges of the upright front face 26 and the upright rear face 28 that are more capable of supporting the forces. The design of the cushioning pads 60, 64 with the particular recesses 84, 86 was obtained as a result of testing of the catch arm 42 in which it was found that a uniform distribution of force on the cushioning pads 60, 64 was not favorable because central portions of the upright front and rear faces 26, 28 were not configured to support these loads. The cushioning pads 60, 64 provide a dampening or shock absorbing feature which dissipates the transmittal of forces to the upright 14 to prevent deformation and/or damage thereof. Use of the energy absorbing catch arms 42 has been found to increase the rated training weight capacity for the weight rack 10 while still maintaining the desired level of durability.

In order to adjust the catch arm 42 to a different desired setting, any weight bar 12 resting on the elongated support member 54 is first removed. Then, using the handle 80, the catch arm 42 is tilted rearwardly and upwardly with the engagement member 48 turning counter-clockwise within the forming walls of the aperture 34 defining the one desired setting. This motion enables the bearing pad 58 to contact the upright front face 26, allows the lower portion of the front wall 44 with cushioning pads 60 as well as the second side wall 52 to shift forwardly and causes movement of the lower portion of rear wall 50 with cushioning pads 64 to close the recesses 86 so that the catch arm 42 can be moved laterally away from the upright 14 extracting engagement member 48 therefrom. The catch arm 42 is now in the released or removed position of FIG. 4 separated away from the upright 14, and can be reinstalled at a different desired aperture setting along the upright 14 in a reverse manner as just described. An internal dampener could also be used in addition to or independently on the attachment bracket 66.

FIGS. 6-12 illustrate another embodiment of a weight bar support assembly in the form of a catch arm 42' which can alternatively be provided on each upright 14'. In this embodiment, the upright 14' is an elongated tube having an upright front face 26', a rear face 28' and opposite left and right side faces 30', 32'. The upright 14' is formed with an aperture arrangement defined by a series of apertures 34', each having a curved slotted portion 88 which merges into a vertical slotted portion 90.

Each catch arm 42' has a generally C-shaped attachment bracket 66' including a front wall 44', a side wall 46' having an opening 92 formed therethrough, and a rear wall 50' provided with a handle 80'. As seen best in FIG. 12, a cylindrical mounting pin 94 projects forwardly from the front wall 44' and has a distal threaded end 96 and a proximal end 98 which projects from an upper surface of the front wall 44'. A cylindrical engagement pin 100 extends through the lower surface of the front wall 44' and a pair of spaced apart clevis brackets 102, 104 is mounted on an outer lower surface of the front wall 44'. The proximal engagement end 98 and the engagement pin 100 are cylindrical members which define an engagement structure.

Figure 11:
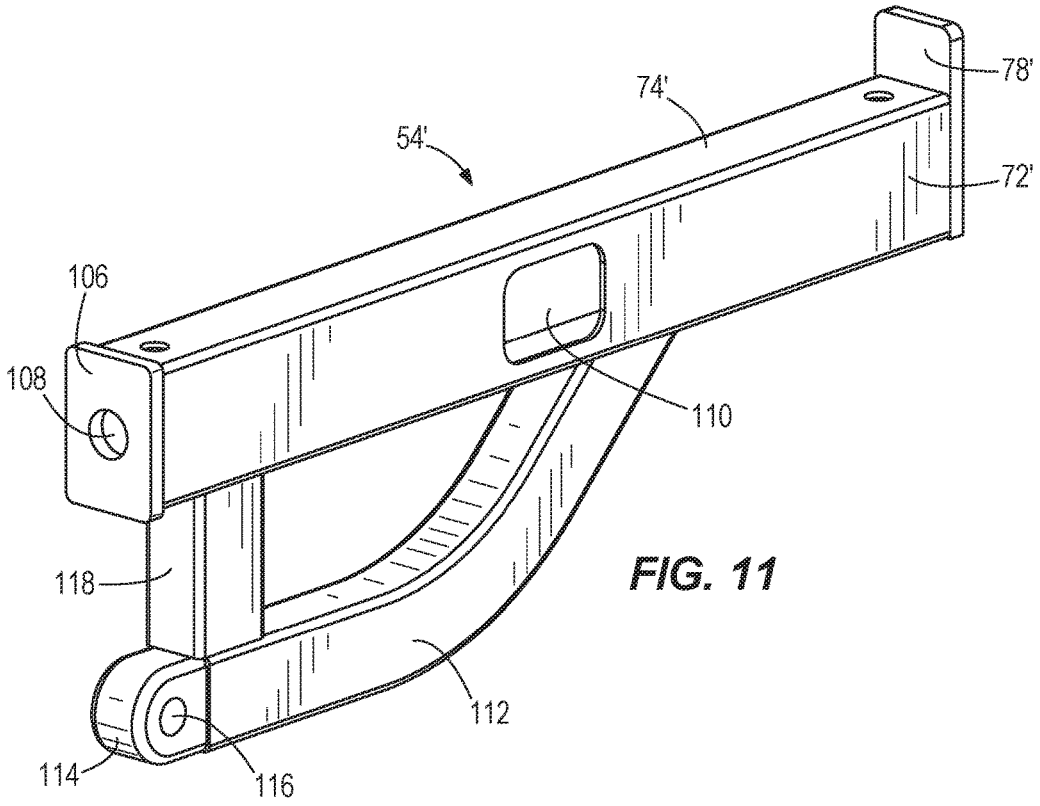
FIG. 11 is a perspective view of a weight support member of the weight bar support assembly shown in FIG. 10.
Figure 12:
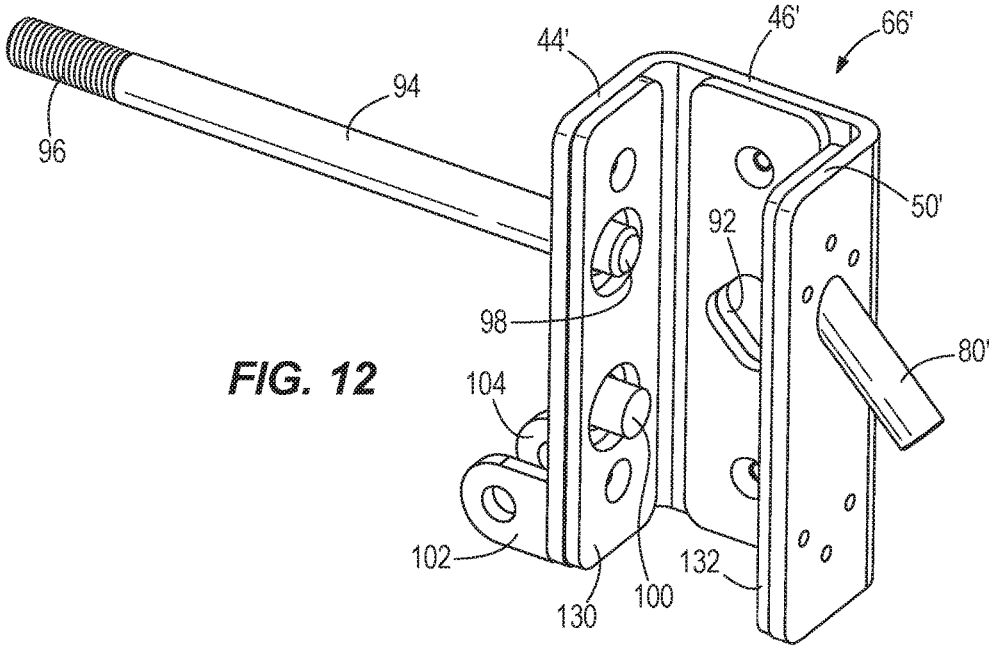
FIG. 12 is a perspective view of an attachment bracket of the weight bar support assembly shown in FIG. 10.

The catch arm 42' also includes an elongated support member 54' having a bottom surface 68', a pair of side surfaces 72', a top surface 74', a distal end plate 78' and a proximal end plate 106 formed with a throughhole 108 (FIG. 11). A mid-portion of the side surface 72' is cut away with an access window 110. A curved brace 112 extends from the bottom surface 68', and terminates in a knuckle 114 having an aperture 116 formed therethrough. A vertical brace 118 is positioned near the proximal end of the support member 54', and extends between the bottom surface 68' and an upper surface of the curved brace 112.

The knuckle 114 is received between the clevis brackets 102, 104 and a connecting pin 120 is passed through the aperture 116 and openings in the clevis brackets 102, 104 so that the elongated support member 54' and clevis brackets 102, 104 are pivotally connected to the attachment bracket 66' at a lower end of the front wall 44'. In the example shown, the support member 54' has a hollow interior designed to receive the mounting pin 94 after the threaded end 96 of the mounting pin 94 is passed through the throughhole 108.

Figure 8:
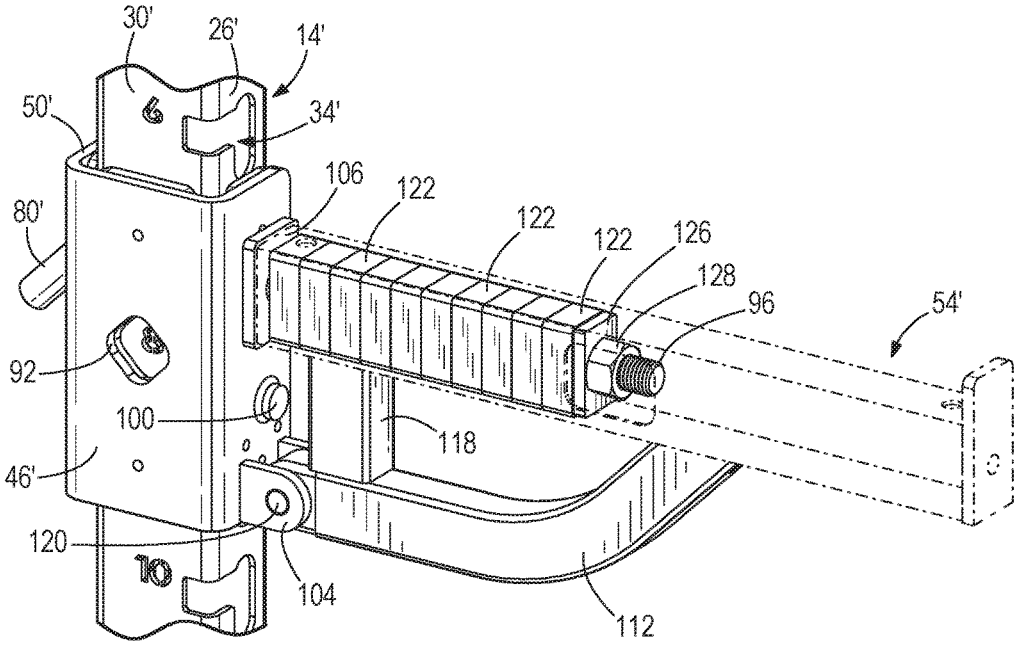
FIG. 8 is a view similar to FIG. 6 showing a portion of the weight bar support assembly broken away.
Figure 9:
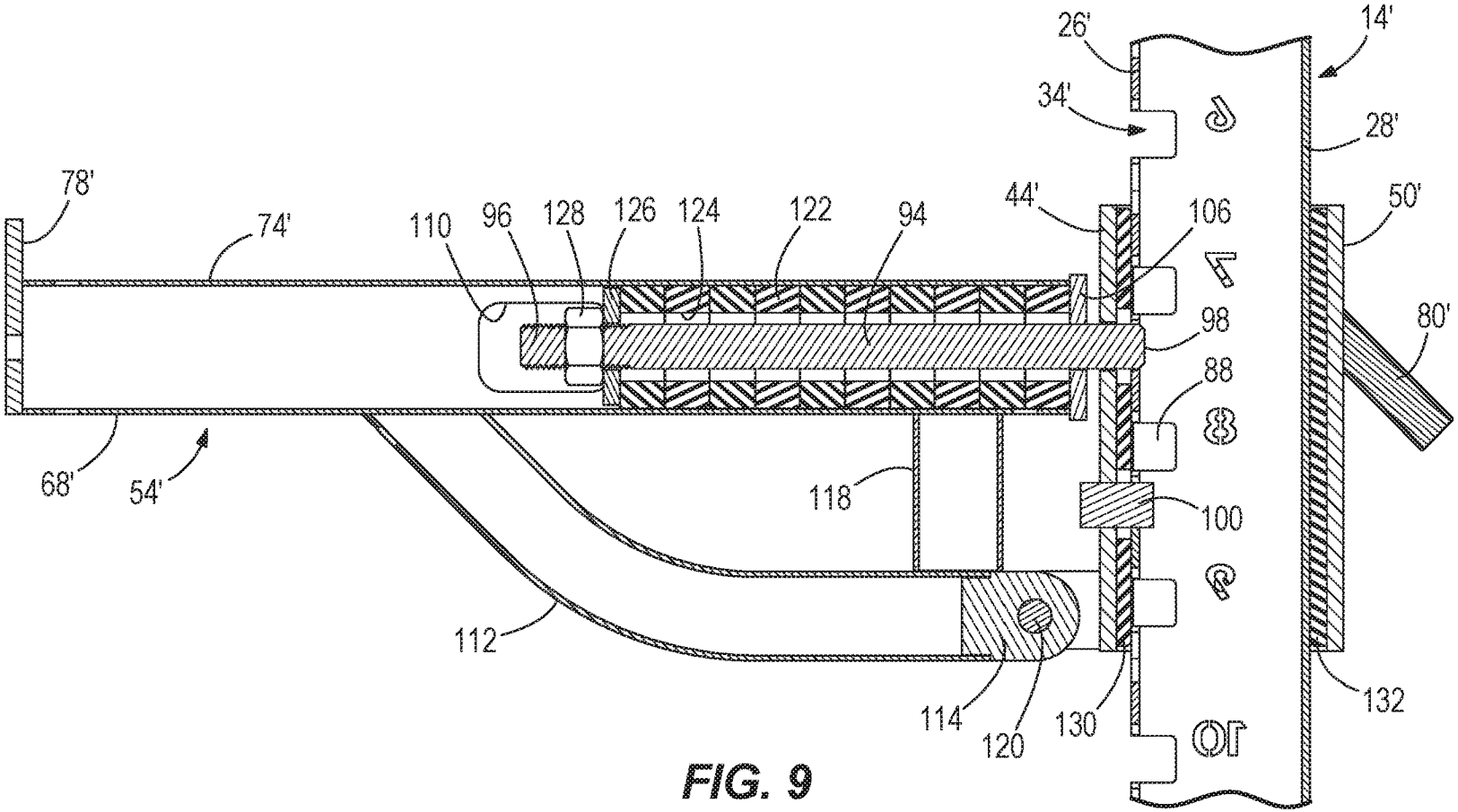
FIG. 9 is a sectional view of the weight bar support assembly installed on the upright as taken on line 9-9 of FIG. 6.

In further accordance with the present disclosure, an energy absorbing arrangement is provided in the form of a laminated group of cushioning elements 122 as shown in FIGS. 8 and 9. It should be understood that the cushioning elements 122 may take other forms and may be constructed of any number, shape or size of elements or a single cushioning element. The mounting pin 94 is passed through central openings 124 in the cushioning elements 122 so that the latter are positioned within the support member 54' on the mounting pin 94 between the end plate 106 and a retainer plate 126 in sliding engagement with the threaded end 96. A nut 128 is turned onto the threaded end 96 on the mounting pin 94 and brought into tight engagement with the retainer plate 126 to secure the cushioning elements 122 within the support member 54'. Similar to the cushioning pads 60, 64, the cushioning elements 122 are designed to provide dampening and shock absorbing characteristics responsive to forces transmitted to the catch arm 42' and the weight rack 10.

Figure 6:
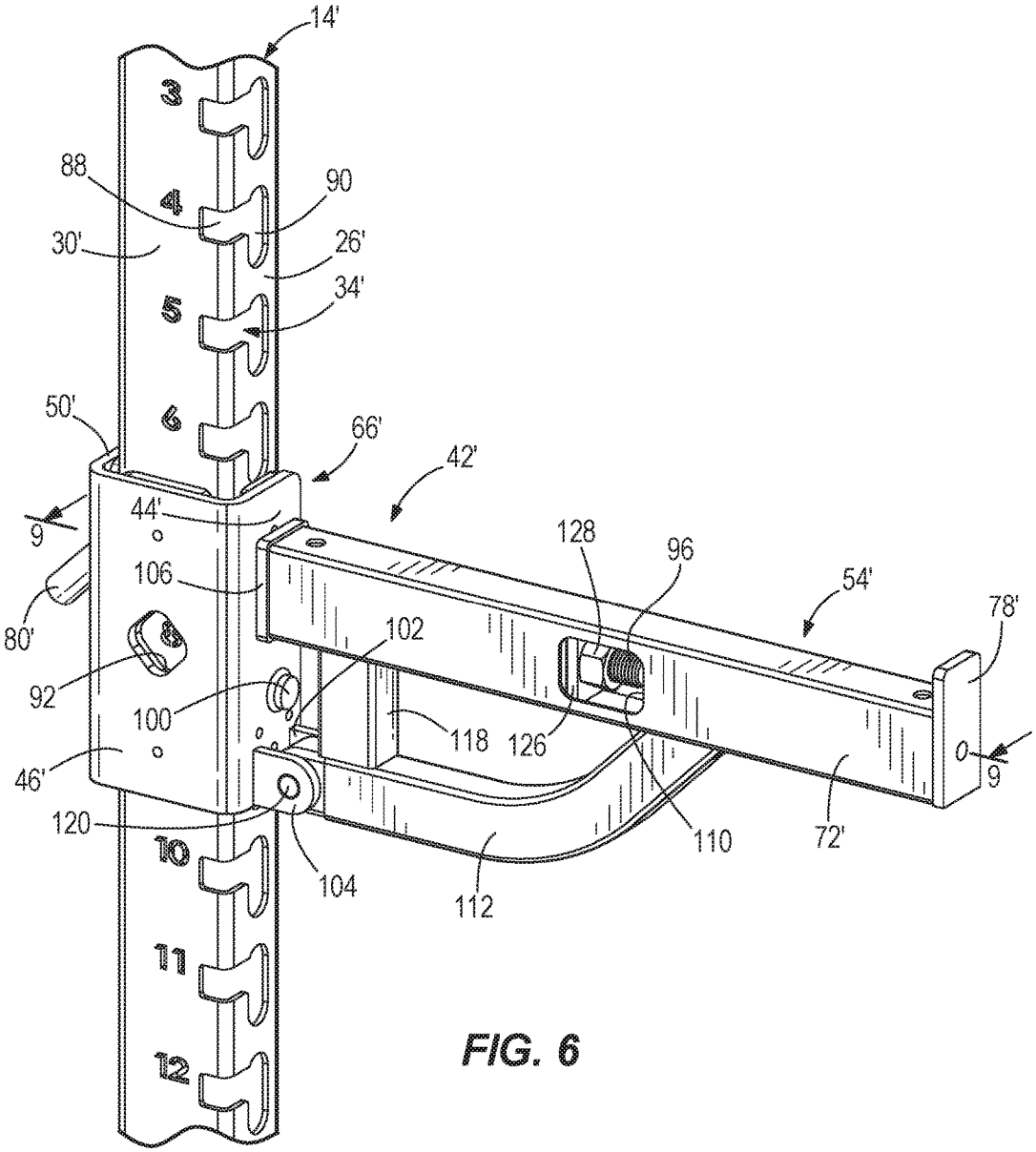
FIG. 6 is a partial front perspective view of a front upright of the weight rack with a weight bar support assembly in accordance with another embodiment of the present disclosure.
Figure 7:
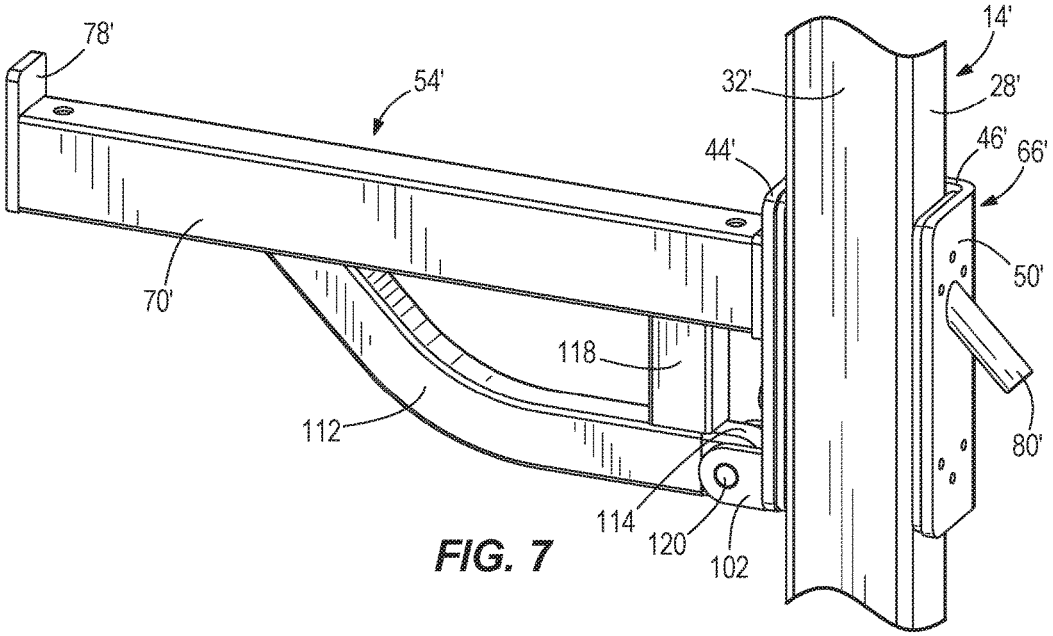
FIG. 7 is a rear view of the upright and the weight bar support assembly shown in FIG. 6.
Figure 10:
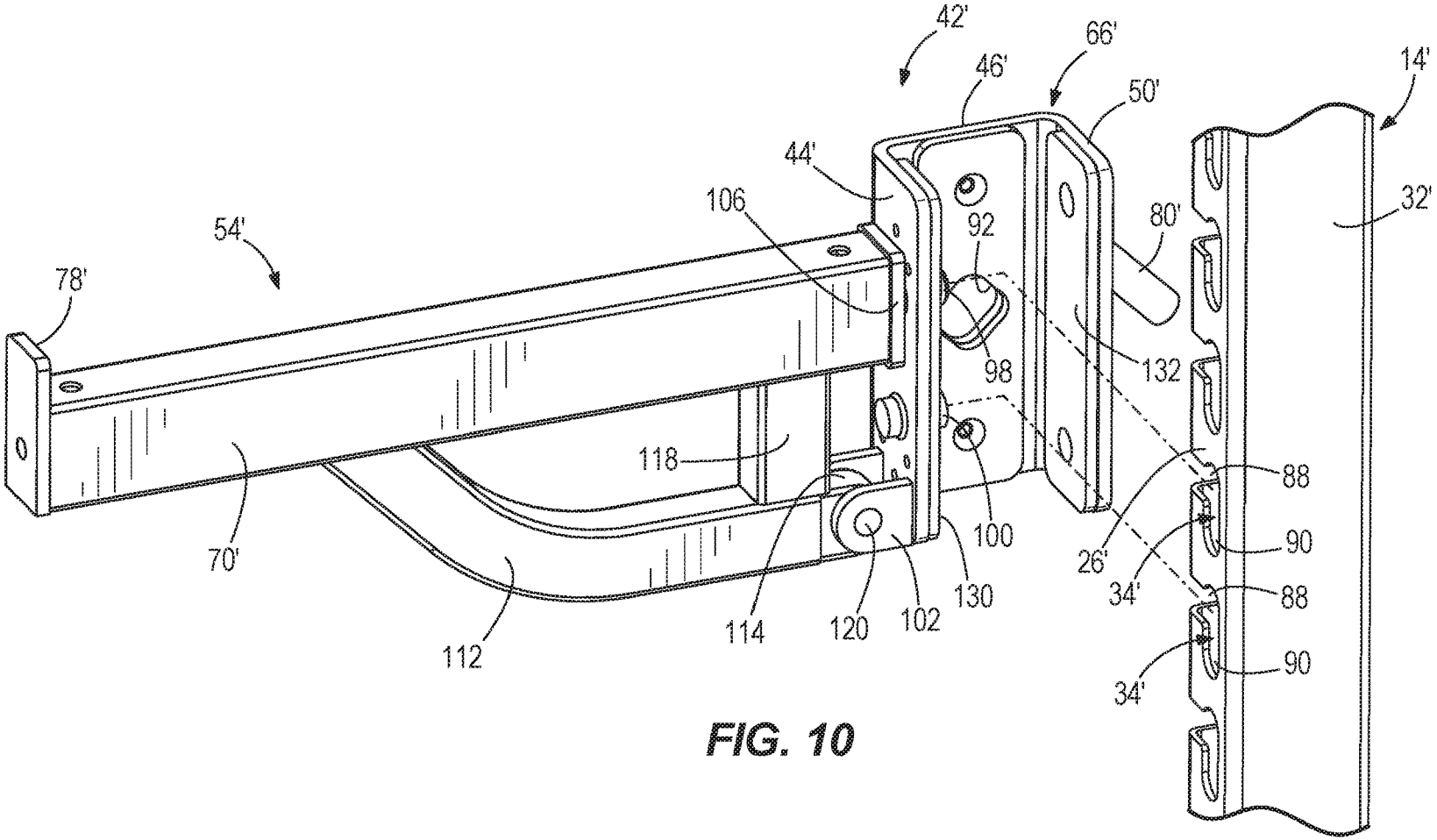
FIG. 10 is an exploded view of the weight bar support assembly and the upright shown in FIG. 7.

The catch arm 42' is designated to be moveable between a released or removed position shown in FIG. 10, and a working engaged position shown in FIGS. 6-9 by using a combination of vertical and lateral motions of the catch arm 42' relative to the upright 14'. To obtain the engaged configuration, the catch arm 42' is moved laterally towards the upright 14' so as to slide the proximal end 98 of the mounting pin 94 and the engagement pin 100 on the attachment bracket 66' within the curved slotted portions 88 of two adjacently disposed and vertically spaced apertures 34' along paths represented by the dotted lines in FIG. 10. The catch arm 42' is then lowered vertically downwardly to move the proximal end 98 and the engagement pin 100 within the vertical slotted portions 90 of the pair of apertures 34' until the proximal end 98 and the pin 100 are lodged at the bottom of the vertical slotted portions 90 to reach the working engaged position shown in FIG. 9. In the engaged position, a paint guard 130 is positioned between the front wall 44' and the upright front face 26', a paint guard 132 is positioned between the rear wall 50' and the upright rear face 28', and a paint guard (not shown) can be positioned between the first side wall 46' and the upright left side face 30' so that the attachment bracket 66' is engaged in non-surrounding relationship with the upright 14'. The elements 122 can be preloaded as desired by adjustment of the nut 128. A user views the one desired setting of the catch arm 42' by noting the numerical setting (e.g. "8") provided on the upright 14' as seen through the opening 92 on the first side wall 46' of the attachment bracket 66', such as illustrated in FIGS. 6 and 8. The user can then be more easily guided in engaging another catch arm 42' in a similar setting on another upright 14' of the weight rack 10.

In the embodiment of FIGS. 6-12, the catch arm 42' provides a spatial orientation that allows for a rotational degree of freedom about a pivot axis of the connecting pin 120. When a downward force is applied to the support member 54' due to contact with a loaded weight bar 12, it creates a rotational moment about the axis of connecting pin 120 that causes the cushioning elements 122 to compress about the mounting pin 94. Accordingly, the cushioning elements 122 provide a dampening or shock absorbing action so as to prevent deformation and/or damage to the upright 14'. The access window 110 formed in the side surface 72' enables a user to access and manipulate the nut 128 if desired, and forms an adjustment mechanism to provide a softer or stiffer dampening characteristic of the cushioning elements 122.

In order to adjust the catch arm 42' to a different desired setting once the weight bar 12 is removed from the support member 54', the handle 80' is first lifted to move the proximal end 98 and the engagement pin 100 out of the vertical slotted portions 90. The handle 80' is then used to move the proximal end 98 and the engagement pin 100 along the curved slotted portions 88 so that the catch arm 42' is laterally moved away from the upright 14'. The catch arm 42' is now in the removed position of FIG. 10, and can be reengaged at a different desired aperture setting along the upright 14' in the manner above described.

As can be recognized by those skilled in the art, the present disclosure provides an adjustable catch arm on exercise equipment which effectively dampens the forces applied to the catch arm upon contact with a loaded weight bar to prevent deformation and/or damage to the exercise equipment. It has been found that the energy absorbing catch arm of the present disclosure can be used on lighter gauge uprights to increase the rated weight capacity of the weight rack while maintaining greater durability and performance/function.

Although only a few examples have been described in detail above, those having ordinary skill in the art will readily appreciate that many modifications are possible in examples without materially departing from the invention. All such modifications are intended to be included within the scope of this disclosure as defined in the claims.

What is claimed is:

1. A weight bar support assembly for supporting a weight bar on exercise equipment having an upright formed with a receiving arrangement, the weight bar support assembly comprising:

a catch arm having an attachment bracket and a weight support member, and an energy absorbing arrangement configured for cushioning a force transmitted to the upright upon contact of the weight bar with the weight support member, wherein the weight bar support assembly is further arranged so that:

the attachment bracket being configured to be engaged with the upright, the attachment bracket including a front wall, a first side wall extending rearwardly from one side of the front wall, a rear wall joined to the first side wall and a second side wall extending rearwardly from another side of the front wall and disconnected from the rear wall, the first side wall being provided with an engagement structure which is slidably and rotatably received within a set of aligned apertures of the receiving arrangement formed in the upright for maintaining the attachment bracket in one desired setting on the upright;

the weight support member extending forwardly from the front wall and configured for supporting the weight bar on the exercise equipment when the engagement structure is received in the aligned apertures; and the energy absorbing arrangement being incorporated within the attachment bracket, the energy absorbing arrangement including a first cushioning pad provided on an inside surface of the front wall, and a second cushioning pad provided on an inside surface of the rear wall.

2. The weight bar support assembly of claim 1, wherein the catch arm is configured to allow for a rotational degree of freedom about a pivot axis.

3. The weight bar support assembly of claim 1, wherein the attachment bracket is configured to be selectively reengaged with the upright upon engagement of the engagement structure with the receiving arrangement at a different desired setting.

4. The weight bar support assembly of claim 1, wherein the engagement structure is a pin structure which extends perpendicularly from the attachment bracket.

5. The weight bar support assembly of claim 1, wherein the energy absorbing arrangement is comprised of an elastomer material.

6. The weight bar support assembly of claim 1, wherein the engagement structure is a cylindrical member extending perpendicularly from the first side wall through the receiving arrangement, which comprises a pair of aligned apertures formed in the upright.

7. The weight bar support assembly of claim 1, wherein said cushioning pads are provided with recesses that are configured to distribute prevailing forces towards outer edges of the cushioning pads which overlap with outer edges of an upright front face and an upright rear face that are more capable of supporting the forces.

8. The weight bar support assembly of claim 1, wherein the catch arm is configured to be engaged with and moved apart from the upright by a tilting motion and a lateral motion of the catch arm relative to the upright.

* * * * *